US011542123B2

(12) United States Patent
Bhaskar et al.

(10) Patent No.: US 11,542,123 B2
(45) Date of Patent: Jan. 3, 2023

(54) ELEVATOR SYSTEM INCLUDING A MOTORIZED MODULE

(71) Applicant: OTIS ELEVATOR COMPANY, Farmington, CT (US)

(72) Inventors: Kiron Bhaskar, Farmington, CT (US); Sam Thieu Wong, Bridgeport, CT (US); Bruce P. Swaybill, Farmington, CT (US); Randy Roberts, Hebron, CT (US); Meghan Mastriano, East Haven, CT (US); Brad Guilani, Woodstock Valley, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 263 days.

(21) Appl. No.: 16/945,833

(22) Filed: Aug. 1, 2020

(65) Prior Publication Data

US 2022/0033224 A1 Feb. 3, 2022

(51) Int. Cl.
*B66B 9/02* (2006.01)
*B66B 1/30* (2006.01)
(Continued)

(52) U.S. Cl.
CPC ..... *B66B 9/02* (2013.01); *B66B 1/30* (2013.01); *B66B 11/005* (2013.01); *B66B 11/043* (2013.01)

(58) Field of Classification Search
CPC ..... B66B 9/02; B66B 2009/006; B66B 2201/307; B66B 2201/306;
(Continued)

(56) References Cited

U.S. PATENT DOCUMENTS 5,713,432 A 2/1998 Richter et al.
10,059,566 B2 * 8/2018 Witczak ..... B66B 1/2491

FOREIGN PATENT DOCUMENTS

EP 0499254 A1 * 2/1992
EP 3632831 A1 * 4/2020 ..... B25J 11/005
(Continued)

OTHER PUBLICATIONS

Extended European Search Report for Application No. EP 21 18 8494 dated Nov. 30, 2021.

*Primary Examiner* — Diem M Tran
(74) *Attorney, Agent, or Firm* — Carlson, Gaskey & Olds, P.C.

(57) ABSTRACT

An illustrative example embodiment of an elevator system includes a cab configured to accommodate at least one passenger or item inside the cab. A motorized module includes a base, a connector supported on the base and at least one drive member supported on the base. The connector is configured to selectively establish a releasable connection between the motorized module and the cab. The drive member is configured to engage a vertical surface, climb along the vertical surface to selectively cause vertical movement of the base, and selectively prevent movement of the base when the drive member remains in a selected position relative to the vertical surface. At least one motor is associated with the drive member to selectively cause the drive member to climb along the vertical surface. The motorized module is vertically movable independent of the cab when the motorized module is released from the cab.

18 Claims, 5 Drawing Sheets

(51) Int. Cl.
*B66B 11/00* (2006.01)
*B66B 11/04* (2006.01)

(58) Field of Classification Search
CPC ..... B66B 2201/308; B66B 11/005; B66B 11/043; B66B 5/027
See application file for complete search history.

(56) References Cited

FOREIGN PATENT DOCUMENTS

| | | | | | |
|---|---|---|---|---|---|
| EP | 3632831 | A1 | | 4/2020 | |
| JP | 2004250186 | A | * | 9/2004 | ..... B66B 11/0095 |
| JP | 2004250186 | A | | 9/2004 | |
| WO | 2017167707 | A1 | | 10/2017 | |
| WO | WO-2017167707 | A1 | * | 10/2017 | ..... B66B 1/24 |

* cited by examiner

ELEVATOR SYSTEM INCLUDING A MOTORIZED MODULE

BACKGROUND

Elevator systems carry passengers, cargo items or both between different levels in a building, for example. A variety of elevator system configurations are known. Some elevator systems operate on a hydraulic machine arrangement to move the elevator car as desired. Other elevator systems are traction-based and rely upon traction between a traction sheave and an elevator roping arrangement to cause desired movement of the elevator car.

Regardless of the configuration of the elevator system, there are situations that require intervention when the elevator system is not functioning as desired. For example, it is possible for an elevator car to be stopped in the hoistway at a location where the car doors cannot open to let any passengers inside the cab out. A so-called rescue operation is needed to move the car to a location at which the passengers can exit the cab. Different elevator system configurations require different approaches to rescue operations.

Other situations that involve or require intervention include maintenance or repair procedures. In some of those, it is necessary or would be useful to allow a technician or mechanic to access one or more locations along the interior of the hoistway. Achieving that can be time-consuming, which introduces additional labor time and cost.

SUMMARY

An illustrative example embodiment of an elevator system includes a cab configured to accommodate at least one passenger or item inside the cab. A motorized module includes a base, a connector supported on the base and at least one drive member supported on the base. The connector is configured to selectively establish a releasable connection between the motorized module and the cab. The drive member is configured to engage a vertical surface, climb along the vertical surface to selectively cause vertical movement of the base, and selectively prevent movement of the base when the drive member remains in a selected position relative to the vertical surface. At least one motor is associated with the drive member to selectively cause the drive member to climb along the vertical surface. The motorized module is vertically movable independent of the cab when the motorized module is released from the cab.

In an example embodiment having at least one feature of the elevator system of the previous paragraph, the motorized module is connected with the cab to move the cab for providing elevator service to the at least one passenger.

In an example embodiment having at least one feature of the elevator system of any of the previous paragraphs, the motorized module includes a controller that is configured to control operation of the at least one motor.

In an example embodiment having at least one feature of the elevator system of any of the previous paragraphs, the controller is configured to control operation of the at least one motor in response to signals from a communication device remote from the motorized module.

In an example embodiment having at least one feature of the elevator system of any of the previous paragraphs, the controller is configured to control operation of the at least one motor in response to a passenger request for elevator service while the motorized module is connected with the cab to cause movement of the cab to provide elevator service.

In an example embodiment having at least one feature of the elevator system of any of the previous paragraphs, the connector includes a clasping member that engages a connector portion associated with the cab to secure the motorized module and the cab together.

In an example embodiment having at least one feature of the elevator system of any of the previous paragraphs, the connector includes a first knuckle, the clasping member is moveable relative to the first knuckle, the connector portion associated with the cab includes a second knuckle, the second knuckle includes a camming surface, and the clasping member pivots relative to the first knuckle as the clasping member engages the camming surface while the motorized module moves toward the cab.

In an example embodiment having at least one feature of the elevator system of any of the previous paragraphs, the motorized module is configured to operate in a first mode in which the motorized module is connected with the cab and in a second mode in which the motorized module is separate from the cab.

In an example embodiment having at least one feature of the elevator system of any of the previous paragraphs, the motorized module is configured to be connected to the cab when the motorized module is above the cab.

In an example embodiment having at least one feature of the elevator system of any of the previous paragraphs, the motorized module is configured to be connected to the cab when the motorized module is below the cab.

An illustrative example embodiment of a method of controlling movement of a cab in an elevator system includes selectively connecting a motorized module to the cab and moving the cab by causing movement of the motorized module while the motorized module is connected to the cab. The motorized module includes a base and at least one connector supported on the base. The connector is configured to selectively establish a releasable connection between the motorized module and the cab. At least one drive member is supported by the base. The drive member is configured to engage a vertical surface, climb along the vertical surface to selectively cause vertical movement of the base, and selectively prevent movement of the base when the drive member remains in a selected position relative to the vertical surface. At least one motor is associated with the drive member to selectively cause the drive member to climb along the vertical surface. The motorized module is vertically moveable independent of the cab.

An example embodiment having at least one feature of the method of the previous paragraph includes connecting the motorized module with the cab to move the cab for providing elevator service to the at least one passenger.

In an example embodiment having at least one feature of the method of any of the previous paragraphs, the motorized module includes a controller that is configured to control operation of the at least one motor.

In an example embodiment having at least one feature of the method of any of the previous paragraphs, the controller is configured to control operation of the at least one motor in response to signals from a communication device remote from the motorized module.

In an example embodiment having at least one feature of the method of any of the previous paragraphs, the controller is configured to control operation of the at least one motor in response to a passenger request for elevator service while the motorized module is connected with the cab to cause movement of the cab to provide elevator service.

An example embodiment having at least one feature of the method of any of the previous paragraphs includes operating the motorized module in a first mode in which the motorized module is connected with the cab and in a second mode in which the motorized module is separate from the cab.

An example embodiment having at least one feature of the method of any of the previous paragraph includes connecting the motorized module to the cab when the motorized module is above the cab.

An example embodiment having at least one feature of the method of any of the previous paragraph includes connecting the motorized module to the cab when the motorized module is below the cab.

The various features and advantages of at least one disclosed example embodiment will become apparent to those skilled in the art from the following detailed description. The drawings that accompany the detailed description can be briefly described as follows.

DETAILED DESCRIPTION

Figure 1:
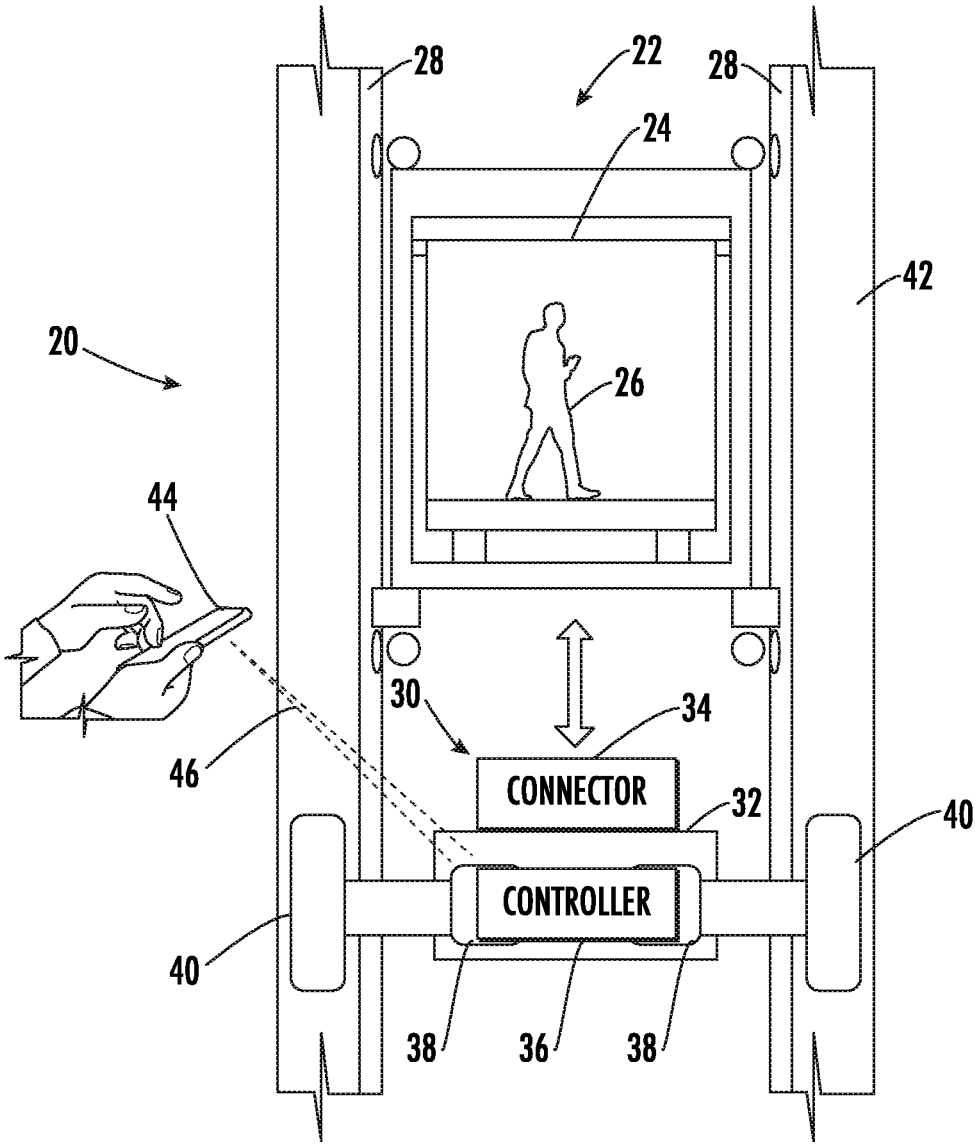
FIG. 1 schematically illustrates selected portions of an example elevator system.

FIG. 1 shows selected portions of an elevator system 20. An elevator car 22 includes a cab 24 configured to accommodate at least one passenger 26 or cargo item. The elevator car 22 is situated to move along guiderails 28 to provide elevator service among a plurality of landings (not illustrated).

Figure 2:
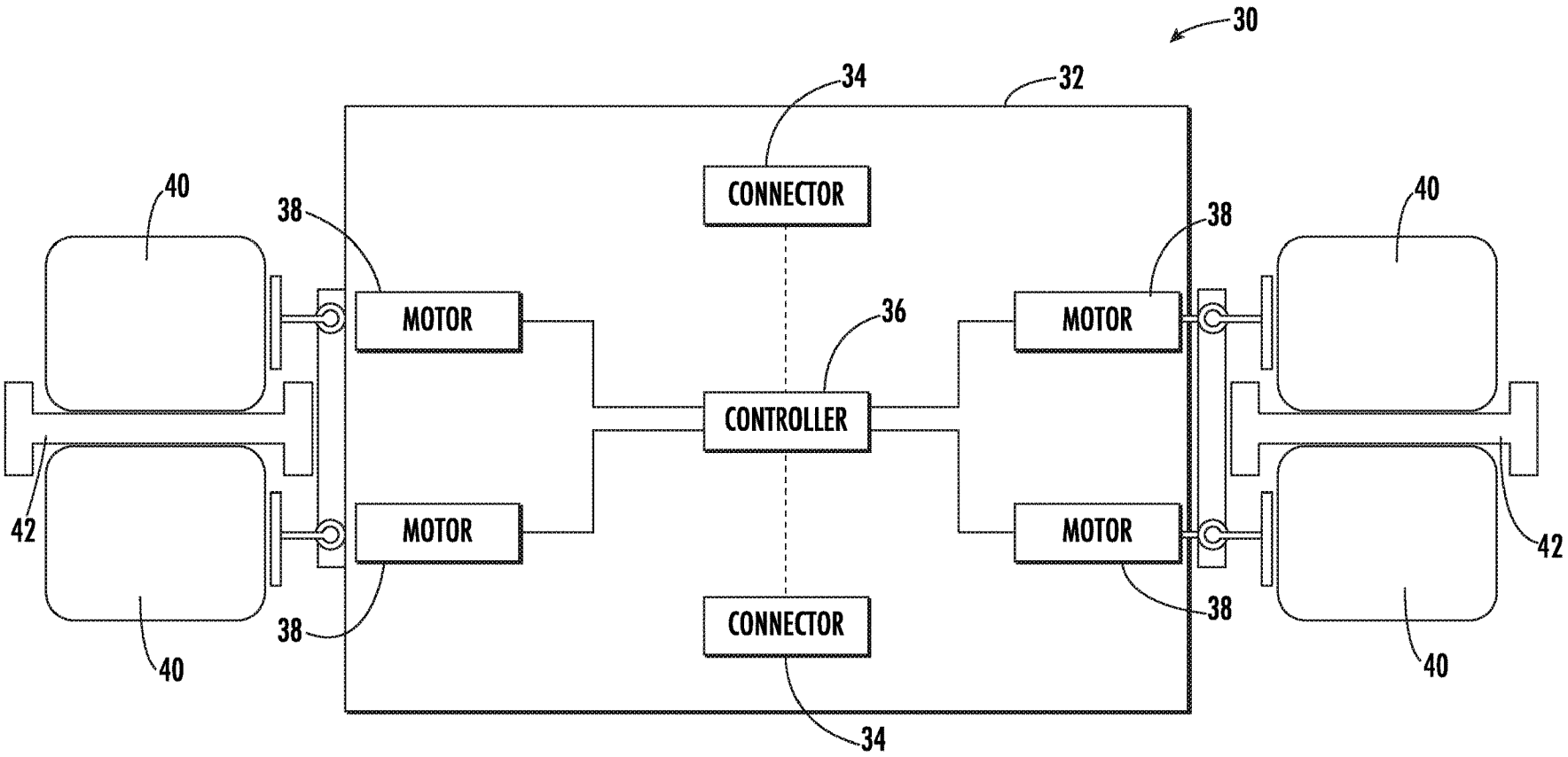
FIG. 2 schematically illustrates selected features of an example motorized module of the elevator system of FIG. 1 as seen from above the motorized module.

A motorized module 30, which is also shown in FIG. 2, includes a base 32. At least one connector 34 is supported on the base 32. The connector 34 is configured to establish a releasable connection between the motorized module 30 and the cab 24. In the illustrated example, the connector 34 establishes a releasable connection with a portion of the frame of the elevator car 22.

The motorized module 30 is moveable in a vertical direction independent of the cab 24. A controller 36 controls operation of motors 38 that are supported on the base 32. The motors 38 selectively cause movement of at least one drive member 40 to cause vertical movement of the motorized module 30. The illustrated example includes multiple rotatable drive members 40, such as wheels, that engage a vertical surface 42 in a manner that the motorized module 30 moves when the rotatable drive members 40 rotate and the motorized module 30 remains stationary in a selected vertical position when the rotatable drive members 40 do not rotate. Other embodiments include differently configured drive members 40 that cause desired vertical movement of the motorized module 30.

In some example embodiments, the vertical surface 42 and the guiderails 28 are formed as a single or integral structure. In some examples, guides of the elevator car 22 follow along one portion of a guide rail structure and the drive members 42 engage another portion of the guide rail structure. In other embodiments, the vertical surface 42 is a separate component from the guiderails 28 and may be, for example, a vertical surface installed as part of the hoistway.

In the example of FIG. 1, the controller 36 may operate responsive to a communication device 44 that wirelessly communicates with the controller 36 as schematically shown at 46. An authorized individual may control movement of the motorized module 30 under a variety of circumstances. Remote control over the movement or position of the motorized module 30 facilitates using the motorized module 30 independent of the elevator car 22.

Figure 3:
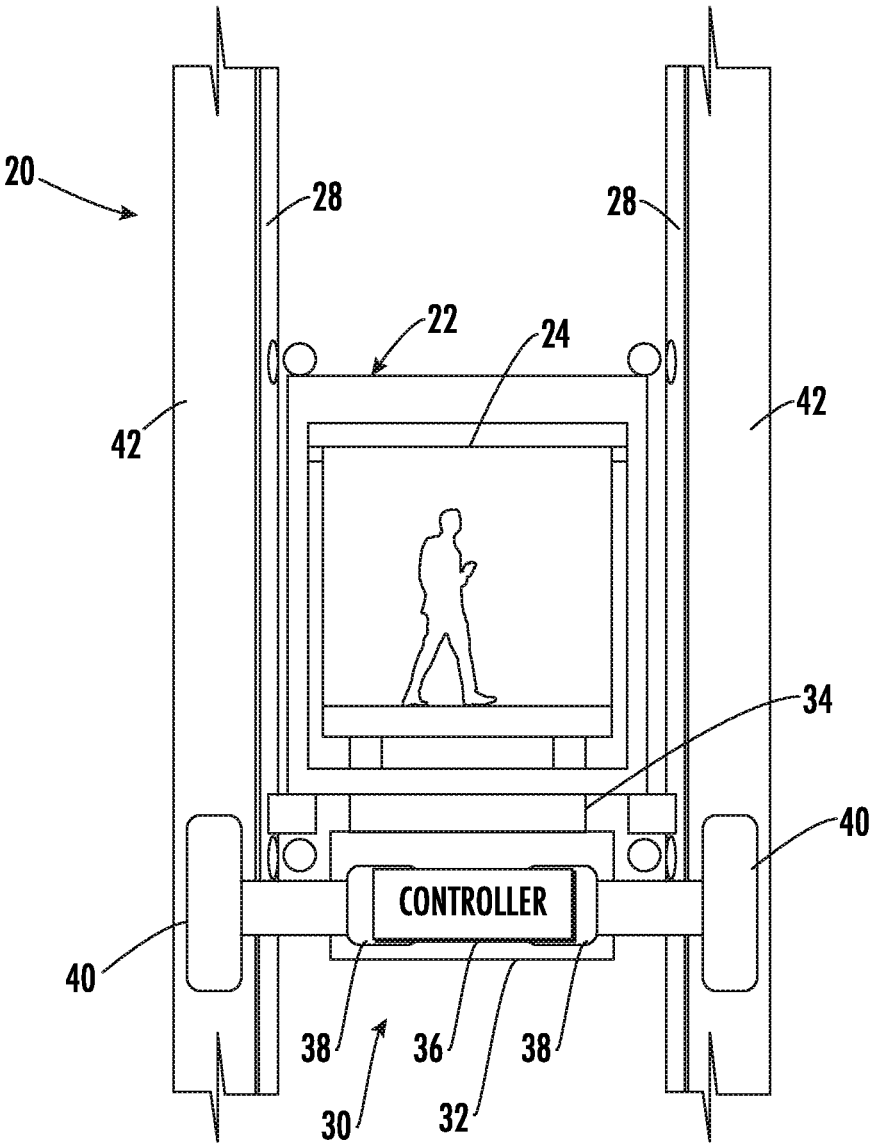
FIG. 3 schematically illustrates one operating condition of the example elevator system.

FIG. 3 illustrates the example motorized module 30 connected with the elevator car 22. In that condition, the motorized module 30 is capable of propelling the elevator car 22 along the guiderails 28 to move the elevator car 22 to a desired location in a hoistway. When the motorized module 30 is connected with the car 22, the motorized module is responsible for moving the car 22 to provide elevator service to passengers. The controller 30 is configured to operate in response to passenger requests for service, such as floor selections using a car operating panel in the cab 24.

The motorized module 30 may also be used only in selected circumstances for moving the elevator car 22. For example, during a so-called rescue operation while the elevator car 22 is stuck within the hoistway at a location where the passenger 26 cannot exit the cab 24, the motorized module 30 may be moved into position to establish a connection with the elevator car 22 and then move the elevator car 22 to a location where the passenger 26 may exit the cab 24.

In some example embodiments, the motorized module 30 may be permanently kept at the location of the elevator system 20. For example, the motorized module 30 may be parked in a pit of the hoistway where the motorized module 30 is out of the way during normal elevator system operation and moved through the hoistway when needed. In another embodiment, the motorized module 30 is portable and can be removed from a hoistway and placed into another hoistway or taken to the site of an entirely different elevator system where the motorized module 30 may be used to selectively move an elevator car.

Figure 4:
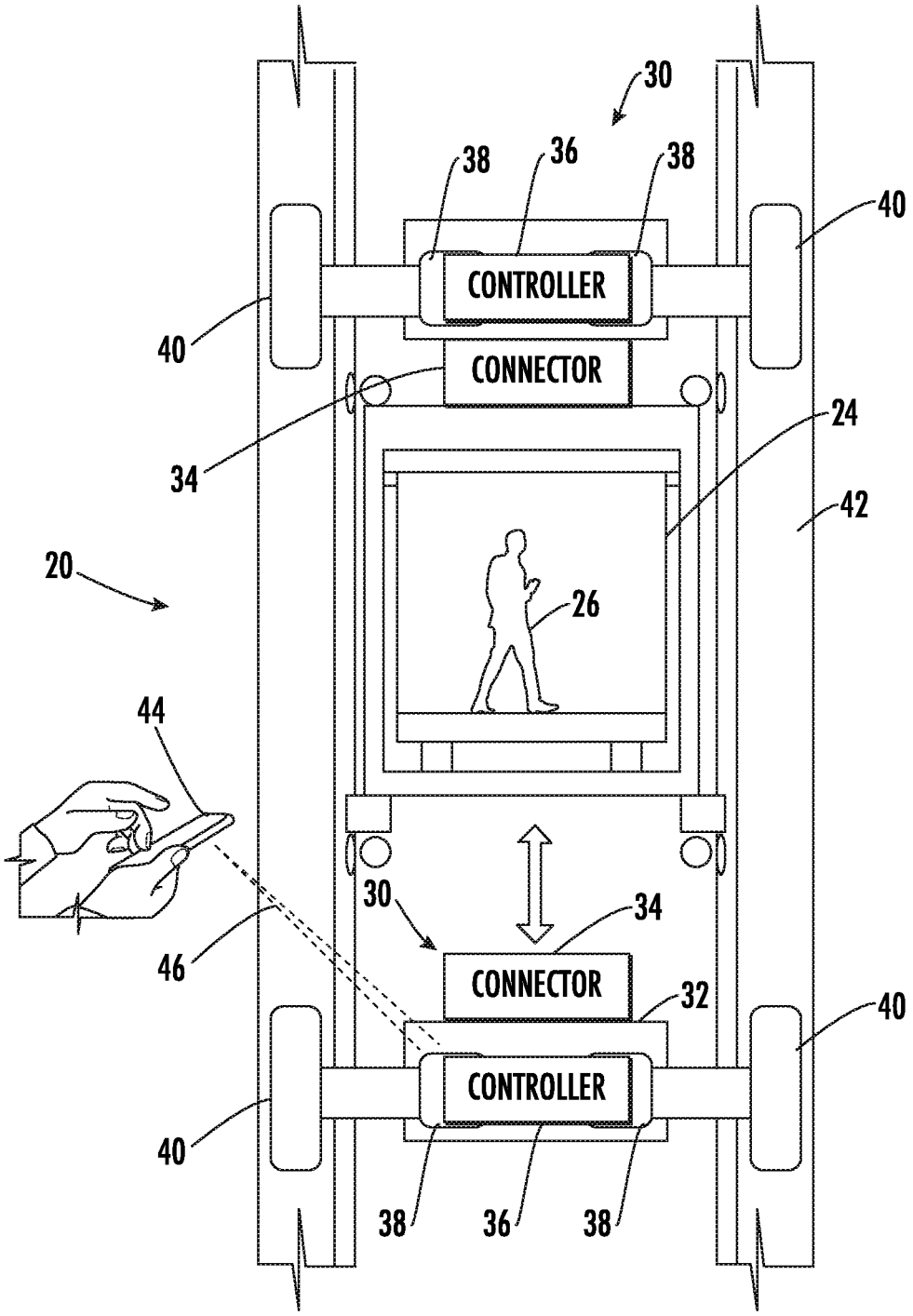
FIG. 4 illustrates an example condition of another elevator system configuration.

FIG. 4 schematically illustrates one example arrangement in which a motorized module 30 is situated above the elevator car 24 and is normally connected with the elevator car 24 on an ongoing basis for purposes of moving the car 24 to provide elevator service. In a situation in which the motorized module 30 above the elevator car 24 is not functioning properly and is unable to move, a second motorized module 30 beneath the elevator car 24 may be moved into position to establish a connection with the elevator car 24. Then the connection between the motorized module 30 above the elevator car 22 can be released and the lower motorized module 30 can move the elevator car 22 to a desired location within the hoistway.

That procedure allows for moving the elevator car 22 to a location where a passenger 26 can exit the cab 24 even when the motorized module 30 normally used to move that car is not operating for some reason. Such movement of the elevator car 22 also facilitates servicing the motorized module 30 that normally supports and moves the elevator car 22. For example, if the motorized module 30 that is normally connected with the elevator car 22 requires service at a location in the hoistway, a second motorized module can selectively be connected with the elevator car 22 to lower the car 22 into a position where a mechanic can use the top of the car 22 as a working platform.

Another possible use of the motorized module 30 is as an independent maintenance or installation platform. An individual may utilize the motorized module 30 to move within a hoistway for purposes of installing, servicing, or repairing a variety of elevator system components at various locations along the hoistway. The motorized module 30 makes certain installation and maintenance procedures easier and more economical by allowing an individual to move to various locations within a hoistway.

Figure 5:
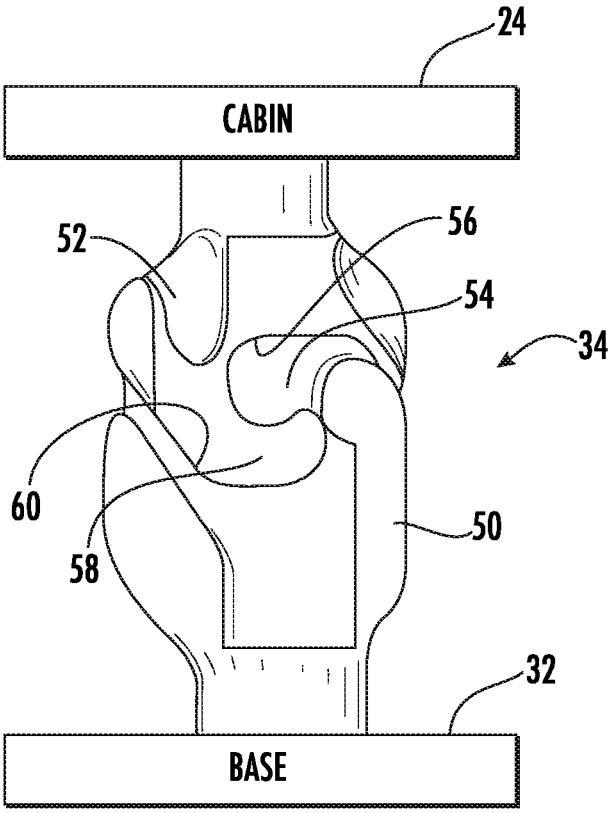
FIG. 5 schematically illustrates an example connector configuration.

FIG. 5 illustrates an example connector 34 that operates like a Janney type railroad car connector. The connector 34 in this example includes a first knuckle 50 connected with the base 32 and a second knuckle 52 associated with the cab 24. A first clasping member 54 moves into a locking position as the clasping member 54 engages a camming surface 56 on the second knuckle 52. A second locking member 58 moves into a clasping or locking position as it moves along a camming surface 60 on the first knuckle 50 as the motorized module 30 moves toward the cab 24. Those skilled in the art who have the benefit of this description will realize other connector configurations that may be useful in their particular implementation.

An elevator system including a motorized module like the example embodiment discussed above allows for selectively connecting an elevator car to the module in a way that allows for moving the elevator car as desired. The motorized module may be used as a primary machine for propelling the elevator car along the hoistway or may be used on an intermittent, selective basis for particular situations.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator system, comprising:

a cab configured to accommodate at least one passenger or item inside the cab; and a motorized module including a base;

at least one connector supported on the base, the at least one connector being configured to selectively establish a releasable connection between the motorized module and the cab;

at least one wheel drive member supported by the base, the at least one wheel drive member being configured to frictionally engage a vertical surface, climb along the vertical surface to selectively cause vertical movement of the base, and selectively prevent movement of the base when the at least one wheel drive member remains in a selected position relative to the vertical surface; and at least one motor associated with the at least one drive member to selectively cause the at least one drive member to climb along the vertical surface, wherein the motorized module is vertically moveable independent of the cab.

2. The elevator system of claim 1, wherein the motorized module is connected with the cab to move the cab for providing elevator service to the at least one passenger.

3. The elevator system of claim 1, wherein the motorized module includes a controller that is configured to control operation of the at least one motor.

4. The elevator system of claim 3, wherein the controller is configured to control operation of the at least one motor in response to signals from a communication device remote from the motorized module.

5. The elevator system of claim 3, wherein the controller is configured to control operation of the at least one motor in response to a passenger request for elevator service while the motorized module is connected with the cab to cause movement of the cab to provide elevator service.

6. The elevator system of claim 1, wherein the connector includes a clasping member that engages a connector portion associated with the cab to secure the motorized module and the cab together.

7. The elevator system of claim 6, wherein the connector includes a first knuckle, the clasping member is moveable relative to the first knuckle, the connector portion associated with the cab includes a second knuckle, the second knuckle includes a camming surface, and the clasping member pivots relative to the first knuckle as the clasping member engages the camming surface while the motorized module moves toward the cab.

8. The elevator system of claim 1, wherein the motorized module is configured to operate in a first mode in which the motorized module is connected with the cab and in a second mode in which the motorized module is separate from the cab.

9. The elevator system of claim 1, wherein the motorized module is configured to be connected to the cab when the motorized module is above the cab.

10. The elevator system of claim 1, wherein the motorized module is configured to be connected to the cab when the motorized module is below the cab.

11. A method of controlling movement of a cab in an elevator system, the cab being configured to accommodate at least one passenger or item inside the cab, the method comprising:

selectively connecting a motorized module to the cab; and moving the cab by causing movement of the motorized module while the motorized module is connected to the cab, wherein the motorized module includes a base;

at least one connector supported on the base, the at least one connector being configured to selectively establish a releasable connection between the motorized module and the cab, at least one wheel drive member supported by the base, the at least one wheel drive member being configured to frictionally engage a vertical surface, climb along the vertical surface to selectively cause vertical movement of the base, and selectively prevent movement of the base when the at least one wheel drive member remains in a selected position relative to the vertical surface; and at least one motor associated with the at least one drive member to selectively cause the at least one drive member to climb along the vertical surface, and wherein the motorized module is vertically moveable independent of the cab.

12. The method of claim 11, comprising connecting the motorized module with the cab to move the cab for providing elevator service to the at least one passenger.

13. The method of claim 11, wherein the motorized module includes a controller that is configured to control operation of the at least one motor.

14. The method of claim 13, wherein the controller is configured to control operation of the at least one motor in response to signals from a communication device remote from the motorized module.

15. The method of claim 13, wherein the controller is configured to control operation of the at least one motor in response to a passenger request for elevator service while the motorized module is connected with the cab to cause movement of the cab to provide elevator service.

16. The method of claim 11, comprising operating the motorized module in a first mode in which the motorized module is connected with the cab and in a second mode in which the motorized module is separate from the cab.

17. The method of claim 11, comprising connecting the motorized module to the cab when the motorized module is above the cab.

18. The method of claim 11, comprising connecting the motorized module to the cab when the motorized module is below the cab.

* * * * *